US008783538B1

(12) United States Patent
Dattilo

(10) Patent No.: US 8,783,538 B1
(45) Date of Patent: Jul. 22, 2014

(54) BUCKET AND TOOL HOLDER

(76) Inventor: Daniel E Dattilo, New Port Richey, FL (US)

( * ) Notice: Subject to any disclaimer, the term of this patent is extended or adjusted under 35 U.S.C. 154(b) by 0 days.

(21) Appl. No.: 13/443,498

(22) Filed: Apr. 10, 2012

(51) Int. Cl.
*A45F 5/00* (2006.01)

(52) U.S. Cl.
USPC ..... 224/673; 224/677; 224/679; 224/148.4; 224/148.7

(58) Field of Classification Search
USPC ..... 224/148.4–148.7, 671, 679, 680, 663, 224/673, 677, 678, 242, 249, 251, 904; 220/735, 736
See application file for complete search history.

(56) References Cited

U.S. PATENT DOCUMENTS

| | | | | | |
|---|---|---|---|---|---|
| 3,997,092 | A | * | 12/1976 | Pogwizd | 224/610 |
| 4,172,542 | A | * | 10/1979 | Lankford | 224/148.7 |
| 4,325,503 | A | | 4/1982 | Swinney | 224/148 |
| 4,527,720 | A | | 7/1985 | Hayes | 224/148 |
| D286,949 | S | | 12/1986 | Hardman | D2/400 |
| 4,765,472 | A | | 8/1988 | Dent | 206/373 |
| 5,016,791 | A | | 5/1991 | Burow | 224/148 |
| 5,163,591 | A | | 11/1992 | Leiserson | 224/148 |
| 5,489,051 | A | * | 2/1996 | Robinson | 224/148.4 |
| D370,559 | S | | 6/1996 | Arndt | D3/229 |
| 5,813,644 | A | * | 9/1998 | Bergin | 248/311.2 |
| 5,915,606 | A | | 6/1999 | Jenson | 224/148.6 |
| 6,283,345 | B1 | | 9/2001 | Butschat | 224/148.4 |
| D464,484 | S | | 10/2002 | Landen | D3/229 |
| 6,719,178 | B1 | * | 4/2004 | Taylor | 224/148.7 |
| 6,769,136 | B1 | | 8/2004 | Martelly | 224/148.4 |
| 6,866,172 | B2 | * | 3/2005 | Shackelford | 224/148.4 |
| 6,945,440 | B1 | * | 9/2005 | Ford | 224/148.6 |
| 7,156,352 | B2 | | 1/2007 | Cudney | 248/211 |
| 7,467,728 | B2 | * | 12/2008 | Lundy et al. | 220/629 |

* cited by examiner

*Primary Examiner* — Nathan J Newhouse
*Assistant Examiner* — Corey Skurdal

(57) ABSTRACT

A work mans belt-mounted holder which allows a container to be suspended from the waist of a work man freeing up his hands. The holder has a belt receiving member of flexible material with slots to securely hold the belt receiving member on a belt.

The holder is fixedly attached to belt receiving member and projects from the receiving member to hold a container. Built into the holder are openings for hand tools to be placed for easy access when needed.

1 Claim, 4 Drawing Sheets

BUCKET AND TOOL HOLDER

BACKGROUND

This invention relates to paint holders. More specifically, to holding devices that are suspended from a person to transport a fluid.

A painter will place approx. a quart of paint in a container with a handle and carry it as he works. Holding a paint brush in one hand, bucket in the other and trying to climb a ladder is hazardous.

Working from a step ladder, user will climb up the ladder and place a bucket of paint on top of it. Once having completed painting the area, the painter climbs down, the ladder and moves to a new location. If he forgets to remove the bucket before moving the ladder it can fall off. This results in time spent cleaning instead of painting.

When working from the ground, the painter usually places the bucket next to him. However this placement of the paint bucket requires repeated bending to reapply the paint to the brush resulting in less productivity. Also the ground of a construction site can be uneven causing the container to fall over. Even with a level surface the bucket can be kicked over from the painter focusing on the area he is painting and not where he is stepping.

Some structures, such as painting around landscape plants leave the painter with no options of resting the bucket on the ground. The painter now must carry the bucket for the time it takes to complete the area. Long periods of time carrying a bucket with paint, can result in muscle fatigue.

Preparing your job site or home project before painting requires some prep work of walls and woodwork. Usually, walls have small holes from pictures and mirrors being hung on them. Occasionally, larger repairs need to be made from damage from moving furniture. Paint may be peeling which will need attention. For these jobs you will need a scraper and putty knife to help make these repairs.

Before the walls are painted there are many different types of wall plates that need to be removed. There may be switch plates, electrical wall outlet plates, telephone connecting plates and cable plates that will require different screw drivers.

As you use these tools, you place them in your pant pockets. When it comes time to find one of these tools, its like reaching into a grab bag. You don't know what you will pull out.

If your applying two different colors of paint on the walls and trim, you will need to use cut in tape to section off these areas. When your painting, you will need a wipe cloth, to wipe up any drips. Now you have all these items you need to keep track of.

U.S. Pat. No. 3,997,092 Pogwizd provides a paint container carrier, supported by straps around the neck and torso. The container has a mounted lid to prevent contamination of paint. This design limits the user of its location that it is worn.

A paint can holder device for use on an individual is disclosed in U.S. Pat. No. 4,765,472 Dent disclosing a bucket attached tool holder. This is a flexible material with tool openings that you attach to the outside of an existing bucket.

SUMMARY

Therefore it is an object of the invention to provide a device for holding a container.

It is another object of this invention to provide a carrier worn from a workers belt.

It is still another object of this invention to provide a carrier that makes a painters job safer.

It is another object of the invention to provide a container holder to be worn at a convenient height so that the user will not have to bend, providing easy access to needed material.

It is another object of the invention, so that it can be worn on users front left side to front right side.

It is another object of the invention to help avoid muscle tension and fatigue by providing a hands free device.

Another object of this invention is to provide a container support means which can be easily connected and disconnected from user.

It is another object of this invention to provide a device for holding a container with specialized openings for carrying tools for the users convenience.

Other objectives and advantages of this invention will become apparent and obvious from a study of the following description and the accompanying drawings which are merely illustrative of such invention.

DRAWINGS

Reference Numerals

Figure 1:
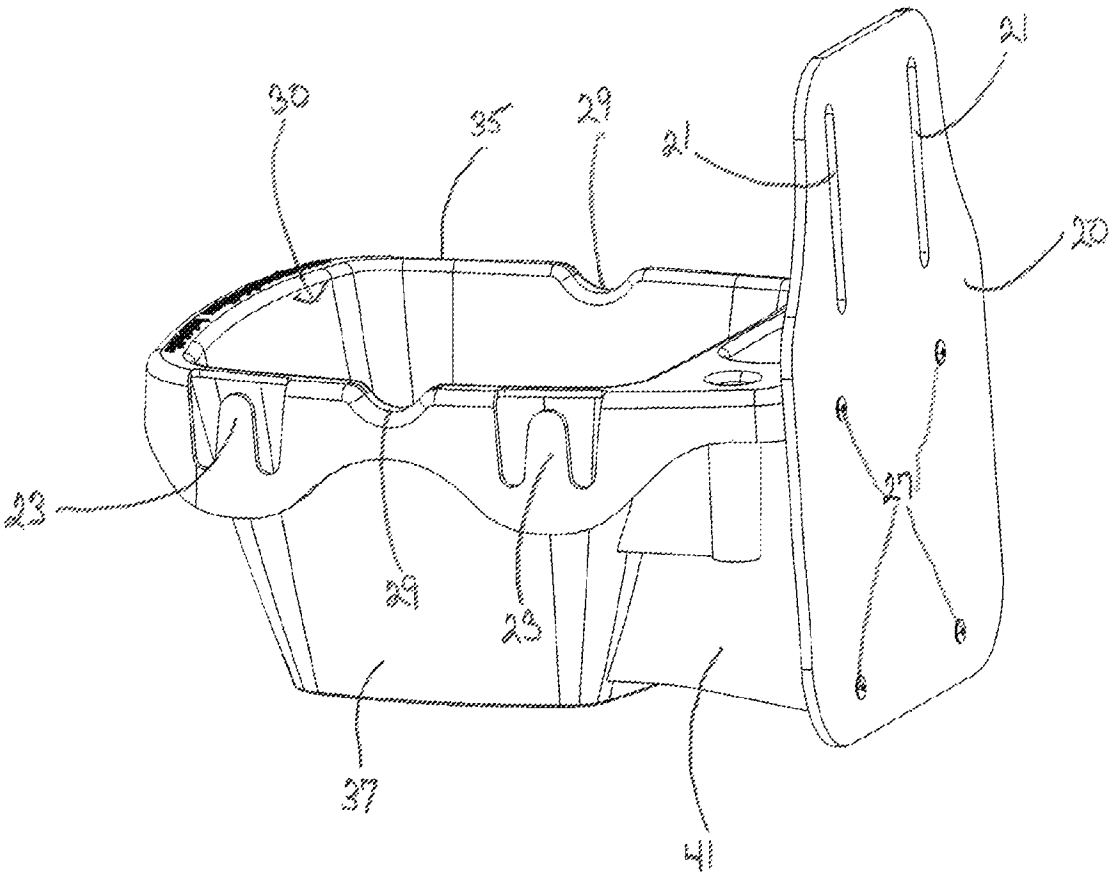
FIG. 1 is a side view of Bucket and Tool Holder of this invention.

20 belt receiving member
21 elongated slot
23 side mount
25 compartment
27 rivet
29 spout opening
30 holder
33 mounting surface
35 rim
37 wall
39 hand tool opening
41 extension arm
43 bucket

DETAILED DESCRIPTION OF THE INVENTION

The belt mounted holder of the present invention depicted in FIG. 1 comprises two principal components: belt receiving member 20 and holder 30.

The receiving member 20 in FIG. 1 is made of a flexible material such as leather, plastic or a fibrous material. This material contours to the waist and pads the user.

Figure 2:
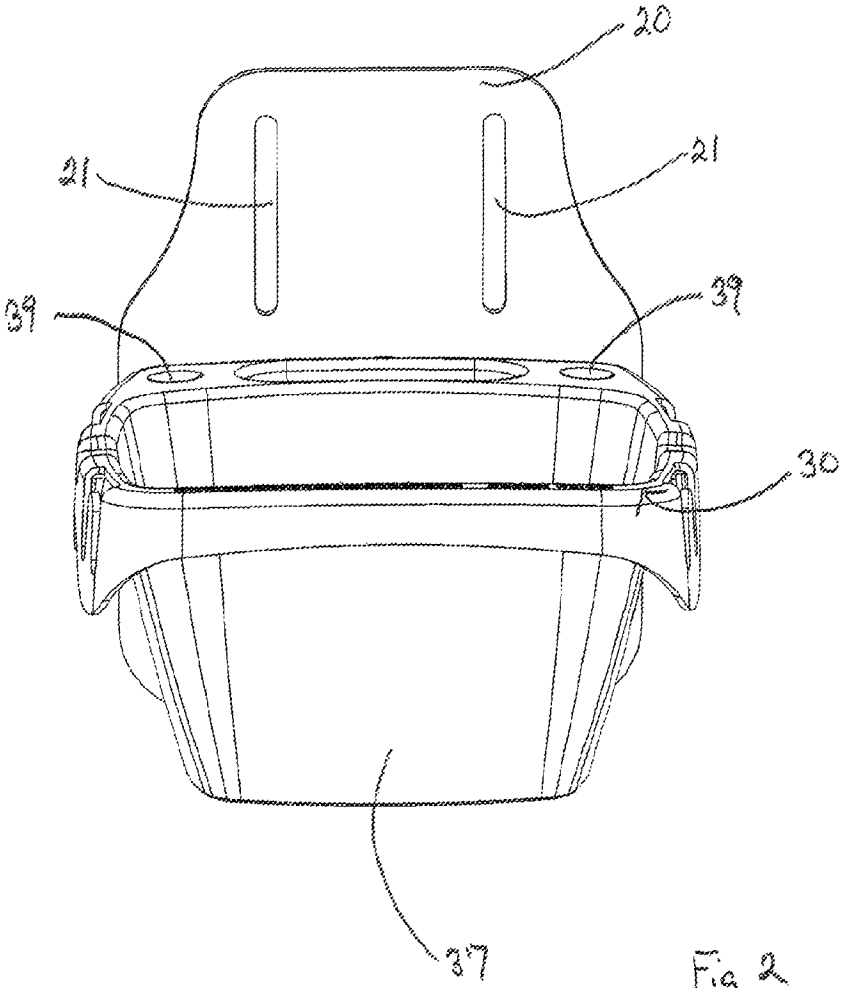
FIG. 2 is a front view of Bucket and Tool Holder of this invention.

Elongated slots 21 as seen in FIG. 2 are provided in, the belt receiving member 20 to supportingly receive the belt normally worn by user. The belt is threaded through the slots 21 of the receiving member 20 and through the belt loops of his pants to secure to user.

In FIG. 1 which is a side view of holder 30, it shows the extension arm 41 which projects out from the receiving member 20. These extension arms 41 position the holder 30 in the proper upright position and distance away from user for ideal working comfort. The receiving member 20 and holder 30 are connected with rivets 27.

On the rim 35 of holder 30 there are spout openings 29 opposite each other to allow placement of bucket in either direction for convenience of user. On the outside rim 35, there are side mounts 23 to allow for a wipe cloth and hand tools to be hung. The holder 30 is designed with side mounts 23 so that additional compartments can be added.

FIG. 2 is a front view of holder 30 and receiving member 20 with elongated slots 21 to receive work mans belt.

Figure 3:
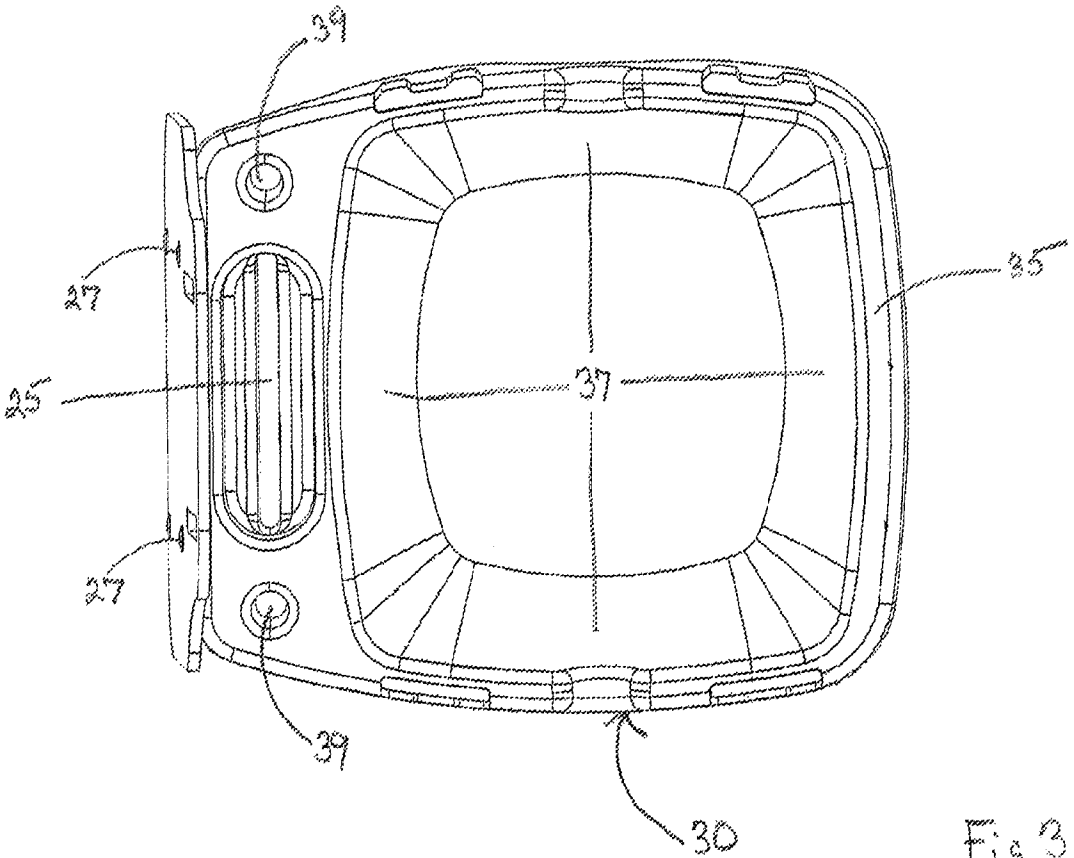
FIG. 3 is a top view thereof.
Figure 4:
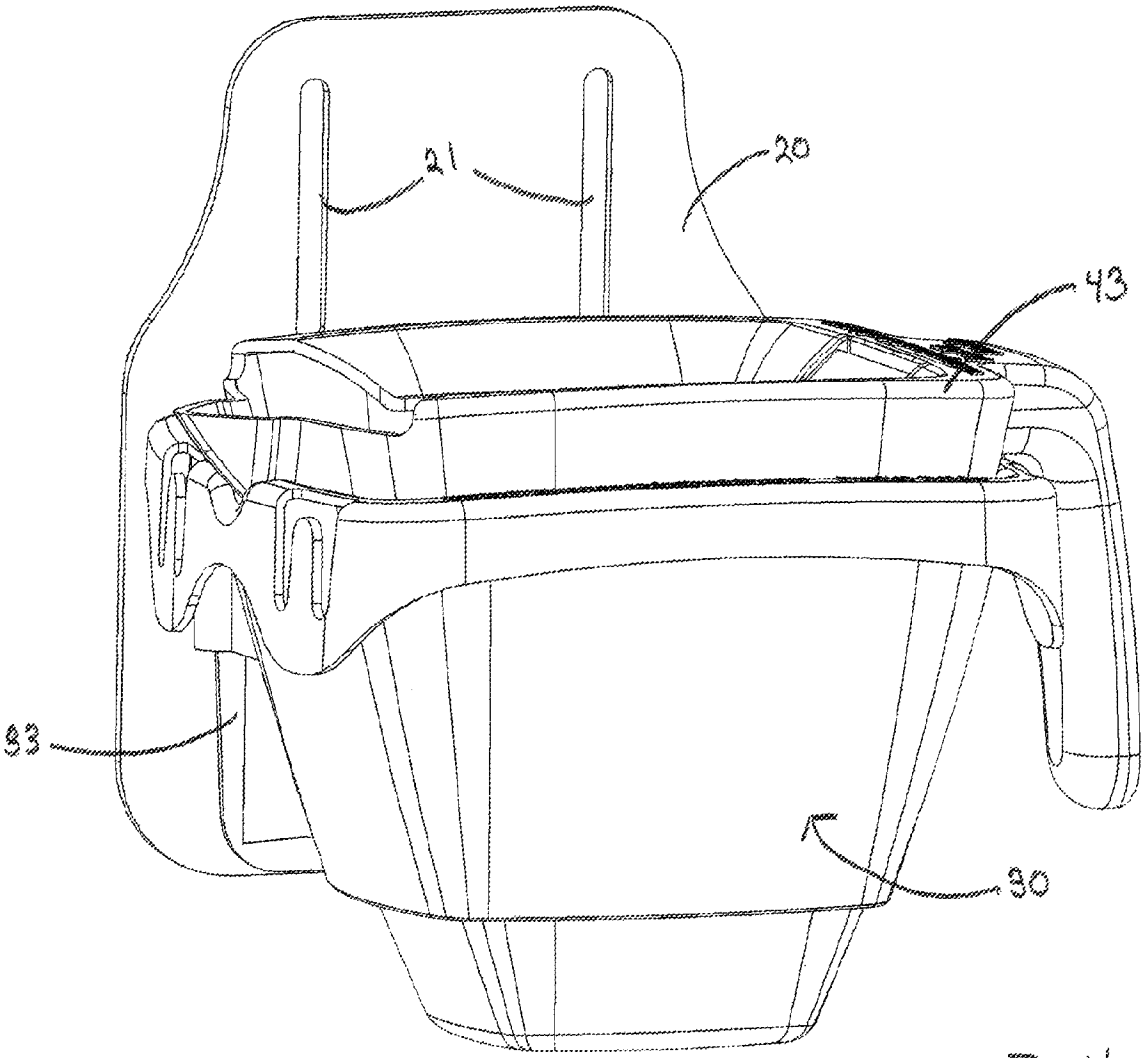
FIG. 4 is a side view of Bucket and Tool Holder with Bucket of this invention.

FIG. 3 is a top view of holder 30, showing the walls 37 sloping inwards to conform with the shape of bucket 43 seen in FIG. 4. This securely holds in place the bucket 43 while carrying liquids and loose materials. The holder 30 made of plastic, has hand tool openings 39 for screw drivers and a compartment 25 for a multi-purpose tool.

FIG. 4 shows the holder 30 with a bucket 43 placed in the cavity. The mounting surface 33 of holder 30, is seen from this angle that connects with the receiving member 20.

The present invention is an easy to attach holder which is light weight and can be worn on right front, or left front of user providing a carrier for a container and tools with easy access to increase productivity of user.

Although the description above contains specificities, these should not be constructed as limiting the scope of the embodiments but merely providing illustration of some of embodiments. For example the holder can have many shapes such as circular, oval, triangular, square, etc. The holding component can also be designed with enclosed bottom. Accordingly departures may be made from such details without departing from the spirit and scope of the applicants general inventive concept.

I claim:

1. A bucket and a tool holder combination attachable to a user's belt, wherein said tool holder receives said bucket, comprising:

a holder body having front, back, left and right sidewalls, an open top, wherein the front and back sidewalls are opposite each other and the left and right sidewalls are opposite each other, and wherein the sidewalls and open top define a receiving space to hold said bucket;

said sidewalls defining a top rim at said open top with a continuous overhang extending downward from an entire perimeter of said top rim, wherein said continuous overhang bends downward along a portion of the left, right, and front sidewalls thereby forming a left, right, and front overhang portion; said left and right over hang portions each having side mounts for holding tape, tools, and additional compartments, said side mounts formed by slots in the overhang portions, and said top rim and overhang portions providing means to carry said bucket, said means to carry formed by openings in said top rim and left and right overhang portions located between said side mounts;

said bucket having a pouring spout and a handle to allow a user the option of carrying the bucket or placing the bucket in the receiving space of the holder for hands free operation, wherein when said bucket is placed in the holder, said pouring spout and handle are received in said openings of said top rim and left and right overhang portions;

said holder body having extension arms projecting out of the back sidewall to form a mounting surface, said extension arms having left, right, and back sidewalls, and a partially closed top, wherein said left and right sidewalls are opposite each other and said back sidewall forms said mounting surface, said mounting surface being angled downward and away from said holder body to position said bucket in a proper upright position when attached to said user's belt, said partially closed top having at least two hand tool openings and a central tool compartment for carrying tools while painting;

and a belt receiving member being attached to said back sidewall mounting surface, said belt receiving member having elongated slots through which said belt can be threaded to easily attach said bucket and tool holder on a left or a right side of said user, and wherein said belt receiving member is made of flexible material that pads the user.

* * * * *